US006000079A

United States Patent [19]

Dranger

[11] Patent Number: 6,000,079

[45] **Date of Patent: *Dec. 14, 1999**

[54] ELEMENTS FOR FURNITURE ITEMS, FURNITURE ITEMS INCLUDING SUCH ELEMENTS AND METHOD OF MANUFACTURING OF SUCH ELEMENTS

[76] Inventor: Jan Dranger, Carl Milles väg 7, Lidingö , Sweden, 181 34

[ * ] Notice: This patent issued on a continued prosecution application filed under 37 CFR 1.53(d), and is subject to the twenty year patent term provisions of 35 U.S.C. 154(a)(2).

[21] Appl. No.: 08/776,049

[22] PCT Filed: Jul. 18, 1995

[86] PCT No.: PCT/SE95/00876

§ 371 Date: Jan. 17, 1997

§ 102(e) Date: Jan. 17, 1997

[87] PCT Pub. No.: WO96/02168

PCT Pub. Date: Feb. 1, 1996

[30] Foreign Application Priority Data

Jul. 18, 1994 [SE] Sweden ..... 9402512

[51] Int. Cl.[6] ..... A47C 27/10

[52] U.S. Cl. ..... 5/706; 5/710; 5/722; 5/738; 425/522

[58] Field of Search ..... 5/706, 707, 710, 5/713, 722, 723, 731, 738, 655.3, 644, 483; 297/440.14, DIG. 3; 425/522, 524, 526, 537; 264/547, 552

[56] References Cited

U.S. PATENT DOCUMENTS

| | | | |
|---|---|---|---|
| 2,253,801 | 8/1941 | Neal | 5/710 |
| 2,810,922 | 10/1957 | Davis | 5/706 |
| 2,823,394 | 2/1958 | Smith | 5/710 |
| 2,978,119 | 4/1961 | Cushman | 5/655.3 X |
| 3,174,181 | 3/1965 | Langecker | 18/2 |
| 3,271,484 | 9/1966 | Brillinger | 425/275 |
| 3,385,466 | 5/1968 | Hook et al. | 220/24 |
| 3,428,974 | 2/1969 | Stuart | 5/710 |
| 3,533,113 | 10/1970 | Stamberger | 5/644 |
| 3,643,268 | 2/1972 | Stamberger | 5/348 |
| 3,815,887 | 6/1974 | Curtis et al. | 5/719 X |
| 4,317,244 | 3/1982 | Balfour-Ritchie | 5/706 |
| 4,348,167 | 9/1982 | Virog, Jr. | 425/522 |
| 4,484,781 | 11/1984 | Phelps | 297/DIG. 3 |
| 4,504,990 | 3/1985 | Scales et al. | 5/483 X |
| 4,694,515 | 9/1987 | Rogers, Jr. | 5/706 X |
| 4,699,585 | 10/1987 | Giese et al. | 425/522 |
| 4,766,628 | 8/1988 | Walker | 5/706 |
| 4,913,642 | 4/1990 | Weber | 425/275 |
| 5,367,726 | 11/1994 | Chaffee | 5/706 |
| 5,585,065 | 12/1996 | Nakamaki et al. | 264/521 |
| 5,795,533 | 8/1998 | Mehnert | 264/529 |

FOREIGN PATENT DOCUMENTS

| | | |
|---|---|---|
| 2718742 | 11/1977 | Germany . |
| 426545 | 1/1983 | Germany . |
| 368502 | 7/1974 | Sweden . |

OTHER PUBLICATIONS

Derwent's abstract, No. P1476 E/43, Week 8243, Abstract of SU 889552 (Tamberg T V), Dec. 25, 1981.

*Primary Examiner*—Michael F. Trettel
*Attorney, Agent, or Firm*—Jacobson, Price Holman & Stern PLLC

[57] ABSTRACT

A container element for a furniture item, including at least one thin-walled closeable support element being fillable with air or the like from a collapsed condition to an expanded condition, the element forming support structure and/or a cushion for a piece of furniture as an arm-chair, a sofa, a bed or the like.

32 Claims, 10 Drawing Sheets

ELEMENTS FOR FURNITURE ITEMS, FURNITURE ITEMS INCLUDING SUCH ELEMENTS AND METHOD OF MANUFACTURING OF SUCH ELEMENTS

FIELD OF THE INVENTION

This invention concerns container elements for a furniture system. The invention further concerns a method of manufacture of such container elements and furniture items including such elements. The invention also concerns a device for adjusting such elements and closing devices for such elements. Finally this application concerns an inflatable mattress.

BACKGROUND OF THE INVENTION

Upholstery including beds comprise about 40% of the total furniture production for the home market. While another remaining 40–50% of the furniture production has undergone radical change into highly industrialised production during the last three decades, manufacture of upholstery is still directed to handicraft.

Since the end of the 1960s, the cost effective, highly industrialized production of cabinets, cupboards, book shelves, drawers, tables etc. has produced flat packages for assembly in the homes. The volume of this business has increased from 0% at that time to about 33% in 1993. This has brought about correspondingly cost effective distribution. During that time there has been strictly no development in respect of the production of upholstery due to absence of technical solutions. Thus the conditions for manufacture and transport has remained unchanged during the years.

Environmental friendly products and processes is a challenge for all industry as indeed it is for the furniture industry. Traditional manufacture of conventional upholstery and beds is in rough terms a process for fixing together a number of different materials to each other. This principle makes separation of the products, one of the fundamentals in recycling, into different categories of material, after a finished life period, expensive and difficult. It is also clear that it is difficult for the manufacturer to find environment friendly materials with acceptable technical performance at reasonable prices. Due to the complexness of upholstery of today it is believed that recycling thereof will necessitate starting new specialised plants for recycling. This will further increase the costs for upholstery. As an example it can be mentioned that the cost for separating one single conventional spring mattress is calculated to be a very high amount in the order of around 60 US dollars (as of May, 1995) which of course will be added to the consumer price.

Another problem with upholstery is the substantial weight and volume of the products which makes storage and transport costly and energy consuming.

Other problems are related to beds. In order to buy a bed, a customer is expected to make a decisive choice of the bed firmness/softness after only a few minutes testing. It is well known that many customers regret their choice which, at best, leads to costly and laborious transports for replacement. Conventional mattresses are of course not possible to adapt to altered demands with respect to softness. Another problem connected to beds is allergy caused by dust, pollen and mite, because the difficulty of cleaning conventional beds.

Altogether conventional upholstery is subject to high costs for manufacture, transport and storage and will be subject to increasing costs in the near future due to the responsibility of the manufacturer to assure that the demands for recycling materials and energy, the environment friendliness of all materials in a product as well as energy saving distribution are fulfilled.

Furniture items with pneumatic support structures are well known. Such furniture items are advantageous, since they are transportable in a highly compressed state which facilitate export as well as distribution via mail order. Further features are low weight and low price.

SE-B-368 502 (Dranger and Huldt) describes a body support device with so called spare elements which are intended to be inflated with air, gas or to be filled with water prior to their insertion into a shape defining cover. The elements are intended to be manufactured from e.g. polyvinylchloride and preferably in a seam welding process. This know device, however, comprises several disadvantages mainly due to leakage and/or fractures, particularly in the seams, already after a relatively short period of use. Unfortunately there exists no effective method of repair of the leaking elements. Further, it is time consuming to inflate the elements and no realistic method of adjusting the coefficient of fullness of the elements.

DE-B-426 545 (Dranger) describes a furniture design with a cover which is filled with balloon type bodies. Also this known device however comprises disadvantages with respect to high permeability of the wall material of the bodies, problems with inflating the bodies and with repairing damages.

U.S. Pat. No. 3,533,113 and U.S. Pat. No. 3,829,918 suggest elements for the use as cushions, mattresses or the like, said elements being fillable with air by pulling apart stiff end surfaces, whereby the air enters into the bodies via wall openings. Also these devices suffer from problems in connection with leakage. Their bellowish design as well as the presence of stiff wall parts make them unsuitable as support elements for soft upholstery.

A common drawback of all known pneumatic furniture items is the problem with inflating the elements to a desired extent due to their air inlet openings being adapted to cooperate with the mouthpiece of a pump. Normally said openings are small in size, ranging from 7 to 10 mm. Since pneumatic elements generally are intended to be inflated to such a high extent that a substantial overpressure is created, the pump must be capable of producing the corresponding pressure A very serious problem with previous pneumatic furniture items is related to leakage. In case of a fracture or a hole in the wall of a support structure element, the user must attempt to place a repair patch covering the damaged area from the outside. This solution is however almost never successful because of often poor adhesion and mechanical influences from external items tending to remove the patch. If the element is seam welded, the most likely place for leakage is in proximity to the seam, which makes an effective repair almost impossible because of the uneven surface in that area. Further, the enclosed air continuously presses the patch outwardly from the area to be patched.

With regard to the problems with known pneumatic furniture items, these items do not provide any realistic alternative to upholstery, since they are not comfortable and reliable enough because they are intended to be inflated to a maximum irrespective the product involving one whole container or being divided into elements. This leads to bad comfort. Further, the price has not been competitive enough, since no true rational production method is envisaged.

SUMMARY OF THE INVENTION

It is an aim of this invention to provide a solution to the above discussed problems concerning comfort, recycling, rational distribution and industrialized production and to obtain container/support elements for a furniture item, an advantageous method of manufacturing such an element and a furniture item comprising the advantages of previously known inflatable pieces of furniture, as low weight and small packages. Further it is an aim of the invention to suggest a realistic alternative to conventional upholstery, which can fulfill forthcoming demands of recycling and minimises leakage and fracture problems.

Large elements (about 30–120 or most preferred 45–80 l) are achieved which may form the support structure of a furniture item. This fact in addition to the element being thin-walled and being produced from a soft and flexible polymeric material increases the possibility of obtaining comfortable furniture items. By the neck portion extending from the bottom of a recess, it is achieved that the part of the element comprising the opening may be flush without any portions protruding outside the general surface of the element which is a great advantage for an element which is forming part of a piece of furniture.

By the element being adapted in such a way that it can be inflated by an ordinary hair dryer, it is possible to radically reduce the time for inflation. It is important to realize that the element according to the invention is normally intended to be inflated to only a part of its total volume (normally between 75 and 90%) to achieve best comfort, and this fact, its size, the element being thin-walled and the fact that the element comprises a neck portion having the stated dimension which allows using a closing element which is conveniently gripped by a hand, allows fast in and outflow of air when inflating and subsequently adjusting the degree of inflation of the element. The invention thus has made a system possible, where the elements during and after the inflation provide a minimum of resistance against the blower in contrast to conventional inflatable elements which must be inflated to a higher extent, and thus demand a correspondingly powerful pump. By "hair dryer" is intended hand held devices, normally with pistol grip, with or without provision for switching off the heating element. Such devices are common in the homes and normally have an output nozzle with a diameter ranging from about 40 mm to about 60 mm. An inner diameter of the neck portion ranging between about 30 and 55 mm therefore allows the element to be conveniently inflated directly using the hair dryer. An intermediate, preferably in the form of an elongated funnel element, may be simply constructed, preferably from a sheet of semi-rigid plastics material. Using such an intermediate between a hair dryer and the neck portion allows inflating the element when the inner diameter of the neck portion ranges between about 15 and 30 mm. By the possibility of using a hair dryer as the blower, the time for inflation of even several elements included in a furniture item will not be regarded as a particularly lengthy period by the consumer. Using an ordinary foot pump is on the other hand regarded as too much work and time consuming. In case of a sofa, the total volume is typically around 600–1000 litres, which consumes a considerable time to inflate.

By the possibility of placing a sealing means such as a repair patch, or simply a suitable amount of contact glue or the like, from the inside of the element onto a damaged area in order to repair a hole in the wall of the element, the above indicated repair problems are radically diminished, because firstly the forces from the contained medium tend to improve the adhesion and secondly the patch etc. is protected from outside forces. The further characteristics of the element (thin-walled, large volume, soft and flexible material) makes it easy, when the element is deflated, to put the inside of the damaged place in line with the neck portion so as to facilitate application of the sealing means from the inside of the element through the opening.

Certain materials to be used with the invention are normally not considered as recyclable, but it is not impossible to use also such materials in particular situations where provision exists for depositing, destruction or restructuring of the materials. These materials include polymers or copolymers or combinations thereof having a Shore hardness ranging from Shore A 35–Shore D 80, such a polyolefins (TPO) or polyolefin based (TOE) or thermoplastic elastomers (TPE) or rubber, siliconepolyurethane or polymers with softeners (e.g. PVC, polystyrene, polyurethane).

Certain materials which are considered as particularly advantageous in that they are inexpensive in production, readily recyclable and provide acceptable or even excellent workability. The preferred materials are EMA (ethyl methyl acrylate), EBA (ethyl butyl acrylate), EVA (ethene vinyl acetate), EEA and VLLDPE.

There are different material related measures which increase the appearance of the material. These measures include a wall material at least essentially being thermoplastic or a material which is similar to a thermo-plastic, with added filler, reinforcement material and/or elastomer modified material, or in that said material is polyethylen LD with a barrier layer consisting of a material that is low-permeable to air or other contained medium such as EVOH, or in case of EMA, EVA, EBA or polypropylen with the additive of an agent for reducing permeability for the contained medium.

Certain materials are particularly suitable in the inventive elements. These materials are sufficiently impermeable to air, provide a pleasant softness, are inexpensive, readily recyclable and suitable in several manufacturing processes, as particularly blow moulding. The material includes EMA by 17–40% or more preferred by 20–30% or most preferred by 24–26% with polyethylene or more preferred LDPE as the main constituent. (All percentage by weight)

To further enhance the ease of manufacture, increase the formability of the used material and bring down possible smell from the material, it is advantageous that a peroxide is added to said material prior to the manufacturing process. This improves the MFR which is an important factor in production, particularly when blow moulding is used as the production process.

It is possible, by the use of a slip agent, that the element is given a pleasant, soft low friction surface and that noise production within the material itself as well as between neighbouring elements is reduced. It has also been found that adding a slip agent to the material radically simplifies adequate placing of inflated elements inside a cover, because the slip agent reduces the friction between neighbouring elements and between the elements and the cover. Further, this way time consuming and difficult adjustments of the elements inside the cover in order to place them correctly will be reduced to lightly patting or simply sitting on the item. Slip agents which have been found effective are, as examples, erucamide and oleamide, both comprising unsaturated amide. Slip agent may preferably be added by from about 1% for low slip to slightly above about 3.2% for high slip.

A blow molding process is particularly preferred according to this invention. Besides being a costworthy process the element is produced such that a truly rational manufacture is possible. The blow moulding process results in a high quality product without seams which radically reduces fracture and leakage problems. This process also produces rounded corners and edges as a natural result from the process which corresponds to the demands and wishes for the form of soft pieces of furniture. Noise between elements are also reduced. The impression of the resulting furniture item is that regions where two elements are meeting each other are considered soft and comfortable which increases the impression of the furniture item as one unit.

Providing the neck portion with an insert brings about that the neck portion is stabilized without the demand for a rigid neck portion resulting from the production of the rest of the element. Another important feature is that this way the inside of the neck portion is given a desired surface, for example smooth and even, which is difficult to obtain in some manufacturing processes. A smooth surface is essential for the cooperation with a preferred closing element. When blow moulding is performed, the insert is applied already prior to the blowing action. Preferably the insert is made of a material which is recyclable together with the rest of the element. Another advantage with a separate insert is that its material properties may be chosen more optimally, since there is no need for considering properties which are important for the rest of the container element.

Certain constructive shapes and measures are used with respect to the invention. Depending on the use within the system, the elements may have a large number of different shapes, but an essentially prismatic shape has however proved to be suitable for a large number of furniture items. For example, prismatic, parallel epipedic, cylindric, partly cylindric or lens like shape, or pillow or cushion shape, is used. Each shape has rounded edges and corners and has been given slightly convex surfaces in the manufacturing process.

Suitable and preferred wall thicknesses of the elements for good comfort are between 0.3 and 1.5 mm or more preferred 0.6–0.9 mm when the material is a homogenous material and up to 3 mm in case of porous rubber, neoprene or similar material.

A support structure module, being designed to be assembled together with other elements to support structures for furniture items of different shape by choice of number, direction and type/shape of a limited number of modules and the element is blow moulded in a modular form tool which is separable, whereby mid sections of different sizes are insertable between rigid end sections ensure inexpensive construction design by modulisation, on the one hand of the furniture item themselves, since a limited number of modules may be combined for forming of a very large number of furniture support structures, and on the other hand of the form tools because different sizes of support modules/units may be produced from a limited number of form parts.

Each element is insertable in a cover, which defines and controls the shape of a piece of furniture, as e.g. an armchair, a bed, a sofa, a pillow or the like by holding together the elements and/or protecting it (them) from abrasive surfaces and objects and allows (where applicable when more than one element inside a cover) interaction between the different supporting elements in one furniture item. Said interaction may be balanced with respect to the places of use of the elements so that a suitable combination stability/softness is achieved. This may be balanced by the producer by choice of extent of "press fit" between the elements or choice of number of elements as well as their shape. Generally a larger number of elements within a support structure gives a more firm appearance of the piece of furniture. This fact may be used in such a way that smaller elements are inserted, e.g. at the sides of furniture items to give these parts greater stability, and larger elements centrally to assure softness and sitting comfort. Further, the consumer is given the possibility of variation, since the extent of inflation of the elements may be varied after his particular wishes, thus contributing to furniture items according to this invention being appreciated as comfortable. It is of course possible within one furniture item to inflate certain elements to a higher extent to achieve firmness and other elements to a lower extent to achieve softness.

It is surprising, in spite of the fact that the comfort requiring as thin a material (in relation to the size of the container) the strength and endurance is maintained by the cooperation between the elements and the somewhat elastic strength of the textile. The textile is thus an integral part of the overall structure.

Since a sofa according to this invention only typically weighs less than 10 kilograms it is fully realistic for a consumer to transport it home from the store even on a bus or by subway.

A surprising effect of the inventive concept is that possible shrinking of a textile cover after washing easily can be compensated simply by inflating the support/container elements slightly less. This is possible since the elements are intended not to be inflated to their full volume. Further, this latter fact is important for the comfort of the resulting furniture item, since the user experiences it as a unit with coacting elements and not each separate element in it self. The cover also provides protection against UV-radiation.

Taken together, this invention with its simplicity and the coordination of the few parts even in larger pieces of furniture ensures a low price level, which is necessary for a large series which in turn is necessary for industrial manufacturing.

An upper layer, which is directed towards the user, is comprised with a layer that allows circulation of air and is levelling. A comfort and sound cushioning layer of fibrefill, batting, polyether or the like is arranged loosely or firmly in connection with a cover. This increases the comfort for the user, preferably, sandwiched materials are used on the parts which are directed towards the user and a quilt has proved to function well. The holding action of the quilt is provided in cooperation with a textile at the backside. In beds, mattresses and seats, the guilt may be thicker or be completed with a layer of foamed polyether.

A cover, which in use at least partly surrounds the support element(s), said cover consisting of, comprising or being impregnating with a fire-proofing material. The material in said cover is so called fibrefill or polyesther, giving a direct fire protection. Thus, reliable fire-proofness is achieved, also in connection with inflammable material in the support elements. This is a very important aspect of the cover. The use of the stated material assures that such properties remain also after several washes. Use of a separate fire inhibiting cover and separate layers in general, textiles etc., also ensures effective material separation with respect to recycling of the materials, since separation is achieved simply by disposing of the separated parts at prescribed places.

By the invention as a whole it is achieved that the present and forthcoming demands of recycling of materials may be easily achieved, since it is possible to manufacture products from materials which may easily be chosen for recycling, environmental friendly burning, for generating energy etc. Total strain on the environment resulting from products according to the invention is thus minimized, also since the components are easily separable and since all strain due to transport and storage is minimized, as well as return transports to recycling. Conventional upholstery, as a contrast comprises unfavourable mixes of materials, large volumes and substantial weight. Forthcoming demands of recycling are very difficult to reach with normal upholstery.

By a second aspect of the invention, elements of a polymeric material are manufactured at a very competitive price in a blow moulding process. This way a surprisingly high comfort is achieved, sufficiently low permeability which e.g. leads to the furniture support structure remaining in its desired expanded state during a very long period, at the same time as it gets good stability. By the opening, convenient cooperation with an ordinary hand held hair dryer is allowed. Said cooperation has proved advantageous results as to the possibility of rendering the elements the suitable extent of inflation using a device already being available in the majority of the homes (see the above discussion). Use of a hair dryer as a blower is only possible due to the nature of the container element. Attempts to expand conventional elements would normally choke the hair dryer. This dimension also allows expanding with the breath of the user, e.g. for final filling of an element. This dimension has also proved to allow applying a repair sealing element through the opening to the inside wall on a damaged, e.g. punched, portion of the wall. The sealing element preferably consists of a self adhesive piece of tape with such properties that it adheres firmly and sealingly to the wall material of the container element. Preferably the adhesive piece is provided with an adhesive also on its opposite side, so as to allow application onto a rod, a thumb, or any other element for convenient handling of the piece when applying it to a hole to be sealed. This second adhesive may be of a less "sticky" kind than that on the sealing side. The dimension of the neck portion is further such as to allow fast in- and out-flow of air or the like.

By the element being provided with a cup shaped portion surrounding the neck portion as is stated in the claim, it is achieved that no rigid parts extend outside the general outer surfaces of the element, and by these portions having a greater wall thickness so as to give them greater stiffness, it is achieved that these portions will remain in the desired state as well as it allows the pulling out of the neck portion in connection with expanding the element and to allow these portions to remain also in this state, where the in use cup-shaped portion in this extended state becomes somewhat more like an outwardly extending cone. The purpose of this possibility is to allow more convenient handling of the neck portion as well as the possibility of somewhat increasing the pressure within the container element, by pressing in the "cone" with the closed opening to regain its cup-shaped configuration. See also the relevant discussion with respect to the first aspect of the invention.

Plastic materials, preferably including low density polyethylene (LDPE), and/or EBA and/or ethylene methyl acrylate (EMA) have been found particularly advantageous in achieving the sufficient impermeability of the element as well as the softness and thus the comfort of the resulting furniture item.

By EMA being present at 17–40% and LDPE being the main constituent, particularly good properties are achieved, which are even enhanced when EMA is present by about 20–30% and excellent at 24–26%. This material has proved to be particularly suitable for blow moulding and gives an excellent comfort to the resulting piece of furniture. It is also advantageous with respect to reduced odor compared to other similar materials.

A closing element having an entering portion of essentially smaller diameter than the inner diameter of the free end of the neck portion, so as to allow quick establishment of a closed state, as well as allowing convenient adjusted outflow of air when adjusting the extent of filling of the container element has enhanced impermeability. The low permeability layer does not necessarily have to be continuous, since presence of such a layer also in parts of the element wall is also effective to reduce the permeability of the element. Linear function to surface covered.

The closing element is cup-shaped and that is comprises a flange at its outer part for covering the surface of the neck portion which is directed outwards. It is achieved that quick establishment of a closed state is easily obtained, since the smaller diameter entering portion allows fast and reliable obtaining of this state. When adjusting the extent of fullness of the elements this configuration of the closing element has also proved to be particularly advantageous.

The flange including an annular portion which surrounds the surface allows covering the outer edge of the neck portion for the protection of textiles etc, whereas manufacturing the closing element from a material and with such a structure that it is recyclable together with the container element further enhances this effect, at the same time as it provides a suitable hand grip.

The inside wall of the neck portion being essentially circular cylindric or slightly diverging conically outwards, whereas the closing element has a conicity slightly exceeding that of the inside wall of the neck portion devices defines a particularly suitable combination of the neck portion and the closing element. Slightly outwards diverging inside wall of the neck portion is particularly advantageous in the production process and the fact that the conicity of the closing element slightly exceeds that of the inside wall of the neck portion ensures a tight fit over a sufficient length of the contact area between said inside wall and said closing element, even when the outer part of said inside wall has been somewhat pressed out due to previous use.

Said neck portion being provided with a prepared tubular insert, providing seat for the closing element has proved to provide particularly good properties of the container device. By providing a preprepared insert, several advantages are achieved:

Absolute smoothness on the inside of the neck portion is ensured and thus the impermeability of the container.

It is possible to produce the container element with a thinner wall at the rest of the "end portion" and neck portion of the container element, due to the presence of said insert. The reason for this is that the insert functions as a reinforcing sleeve. The neck portion being thinner and the wall thickness of the container element being more even throughout the element, reduces or eliminates the presence of clods of material at the end portion. This feature also reduces or eliminates the tendency of forced deformation to the neck portion when this is pulled out. In the pulled out state the above indicated clods, or in general irregularities, give an oval shape to the outer part of the neck portion, making it difficult to apply the closing element.

Said insert being manufactured from a material somewhat similar to that of the container element, however, preferably at least slightly less soft, so as to allow choice of specific material properties in the container element as well as in the insert provides the possibility of optimizing the material in the container element as well as the material in the inner part of the neck portion, so as to achieve the desired properties of the respective parts.

By applying the insert into the neck portion during the blow molding process a particularly advantageous and easy to manufacture device is obtained, at the same time as it is easy to obtain total impermeability in the contact areas between the neck portion of the container element and the insert.

By having the insert on its inside surface being provided with surfaces cooperating with the closing element, e.g. threads, makes it possible to choose the most effective configuration of the insert inside wall.

A furniture item as e.g. a bed, a sofa, a pillow or the like is provided, with excellent comfort, which is produced at a competitive price and which is long lasting and durable.

By said container element having essentially prismatic, parallel epipedic, cylindric, partly cylindric or lens shaped shape or a mix of said shapes, or pillow or cushion shape and having rounded edges and corners and has been given slightly convex surfaces in the manufacturing process, particularly effective and advantageous shapes of the element and thus good adaption to various forms of a furniture items is achieved.

When the invention is used as a bed or a mattress, easy adjustability is obtained by controlling the extent of filling the elements involved. It is also possible to control the softness differently in different parts of the bed or mattress. By the small package dimension, a bed according to the invention is very well suited as an extra bed. Advantages over water beds are also achieved. There is thus no risk of water leakage, no need for any heating arrangement, no need of environment damaging algaecides and no problem with water wave formations inside the bed. These advantages of course relate to all aspects of the invention.

The invention also concerns the device for allowing adjustment of a container device. This device consists of a generally U-shaped adjustment device which when placed with the uprights astride of a container element lying on a flat surface, makes it possible in a convenient way to control and adjust the extent of inflation of a container element. This way it is very easy to control that the said extent is the same for several similar elements. It is further, of course, possible to control what extent of the desired volume that has been reached. By making this device adjustable in height it is possible to obtain a desired extent of fullness for the respective element. The device is preferably manufactured from a plate-like material as e.g. corrugated cardboard or corrugated synthetic material. The fastening between the separate parts is obtained by conventional fastening elements or by cut-outs on corresponding places on the respective parts.

The invention further also concerns a method of manufacturing a container which enables the use of the cost effective blow moulding method for manufacturing a relatively large thin-walled container in a soft and flexible polymeric material. The applicant appreciates that it is surprising to be able to produce such large elements in such a thin and soft and flexible material. By reexpanding the element substantially directly after—"the blow moulding process it is assured that the desired shape is established within the wall material of the container. It could be said that the wall material receives a "molecular memory" of the expanded state by the method according to the claim, which leads to the container, after having been handled in a collapsed state, fast and safely retains this state when expanded without tending to become concave, comprise folds or other undesired deformations that would otherwise occur. By the reexpansion, further a leak test of the element, is easily achieved. The reexpansion time period could preferably range between about 6 and 36 hours. Other advantages of this method are clear from the above discussions concerning the elements.

It is preferred that the container is folded for package directly after removing the closing element, thus taking advantage of the tendency of the deflating element to form neat folds. It is of course also possible to fold an already collapsed container, but this procedure is far more difficult and time consuming.

Finally the invention concerns a closing device whereby a fast, convenient and reliable closing of the container element is achieved. By the entering portion having smaller dimensions than the diameter of the neck portion, it is achieved that it is possible to establish a closed state fast when inserting the closing element. This brings about an essential and important difference comparing to previously known lids of different kinds which are not capable of providing such fast establishment of the closing state.

In a container element/device it is also sometimes of interest in connection with the closing in a controlled manner to allow certain amounts of the air contents to escape for achieving a desired extent of inflation. Also for this aim this closing device is a very well suited solution, since it is possible to partly take out the closing element in a controlled manner from the neck portion in a choking manner so that a smaller opening is formed. This way it may easily be controlled that the support elements obtain the desired expanded shape.

An increased isolation of a coarse edge on the neck portion for protection of textile material etc. is implemented.

The sharp flange(s) assure releasable fixing inside the neck portion by slight deformation of the cooperating surface. By arranging an inner flange on the closing device which in the inserted position is located beyond the insert a locking action is obtained. By making the sharp flanges such that they form a small angle in the outward direction to the perpendicular of the axis of the closing element a snap action fastening is obtained.

Further advantages of the invention should be clear to one skilled in the art that similar inventive measures in connection with different aspects of the invention bring about similar advantages.

BRIEF DESCRIPTION OF THE DRAWINGS

The invention will now be described further in connection with embodiments with reference to the annexed drawings, whereon.

DETAILED DESCRIPTION OF THE PREFERRED EMBODIMENTS

Figure 1:
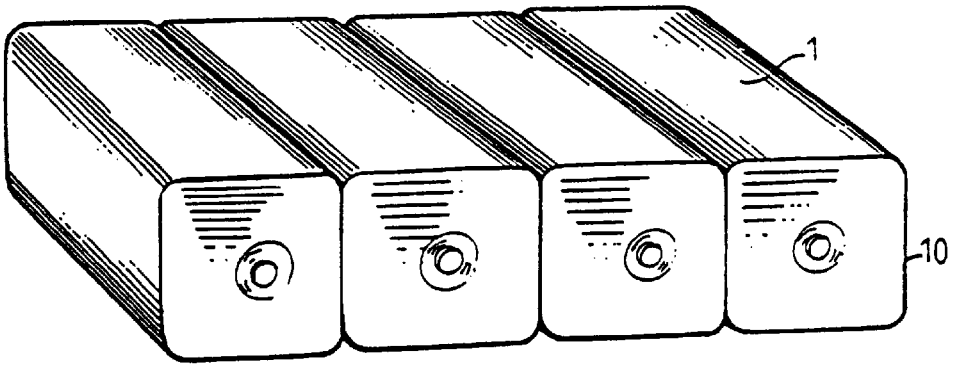
FIG. 1 shows a basic support structure of a bed, a sofa or the like formed from a number of support/container elements and being part of a furniture item according to the invention.

FIG. 1 thus shows the principal structure of a support structure of a furniture item for sitting and/or lying purposes. Four container or support elements 1 are used in this case, comprising essentially generally prismatic shape, but with rounded edges and corners for comfort as well as ease of production. Each element on one of its sides is provided with a closable opening 10, in the form of a neck portion extending from a cavity or depression in the wall, for cooperation with an insertable closing element. This is to achieve that said neck portion in use is situated with its outer surface inside or generally in level with the outer wall surface of the support element. Normally the opening is placed centrally on one of the sides.

Figure 2:
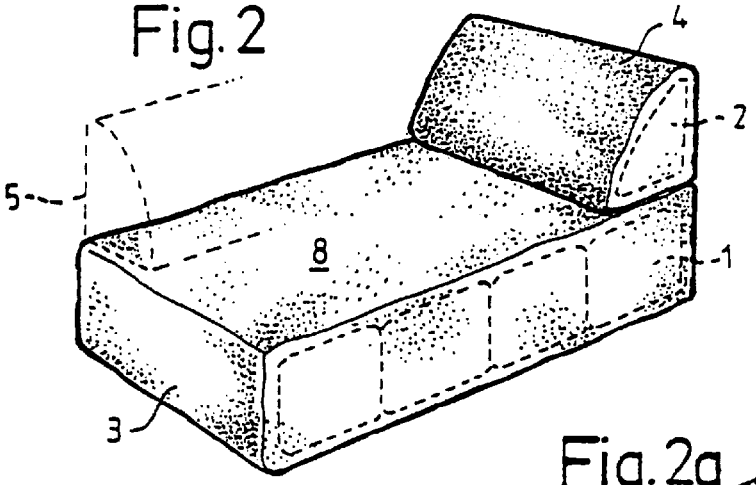
FIG. 2 shows a couch or a bed emanating from the support structure according to FIG. 1.

FIG. 2 shows a couch formed from the support structure according to FIG. 1, wherein a cover 3 covers the support structure. The cover is sewn to lie closely against the expanded support elements and holds these together. In this case the couch is provided with a head cushion 2 with rounded resting surface. The element 2 in question is covered with a cover 4 which in this case is a separate cover which if necessary is releasably fixed onto the cover 3 by means of fasteners, VELCRO® hook and loop type fasteners or the like. The upper part 8 of the cover 3 as well as possibly also the curved resting surface of the cover 4 may for increased comfort be provided with a layer allowing circulation of air, made from foamed plastic, e.g. polyether, batting or the like. The reference number 5 indicates with interrupted lines back cushions (c.f FIG. 2*a*). The cover 3 may also comprise a loose cover hanging from the top only covering the visible parts of the support structure, but if necessary the cover may entirely surround the support structure, where in this case it is provided with a wear resistant textile of a suitable kind on the floor side. For enabling insertion of the support elements into a closed cover, zippers, VELCRO® hook and loop type fasteners or the like are used in a per se known manner. A complete sofa may be completed from the principle of FIGS. 2 and 2*a*. See also FIG. 4 for an alternatively shaped sofa.

Figure 3B:
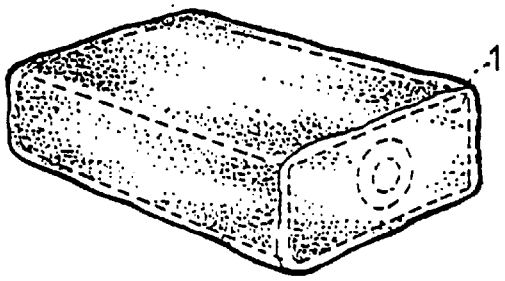
FIG. 3*b* shows a simple pillow.
Figure 3A:
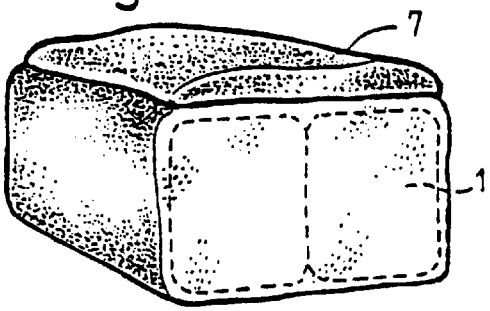
FIG. 3*a* shows a so called large-pillow, designed according to the invention.

FIG. 3*a* shows a large-pillow consisting of two support elements 1 with a cover and an overlying levelling cushion 7 of a foamed material, batting or other suitable comfort increasing filling material. FIG. 3*b* shows a pillow consisting of one element 1 inside a cover.

In this connection it could be mentioned that furniture items according to the invention are well suited to be used as outdoor furniture and pool-side furniture (the items are of course floatable). In this case the elements could be used with special resistant covers or without cover. In the latter case they may comprise a UV-filter and be particularly thick-walled. If no cover is used it is possible to provide the elements with integral fastening ears or the like for cooperation with ropes, bands or the like.

Figure 2A:
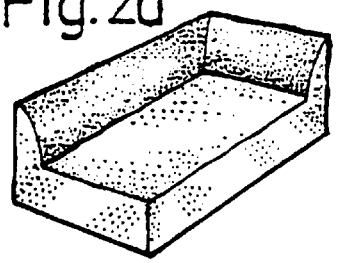
FIG. 2*a* shows the couch or bed according to FIG. 2 provided with support for the back.
Figure 4A:
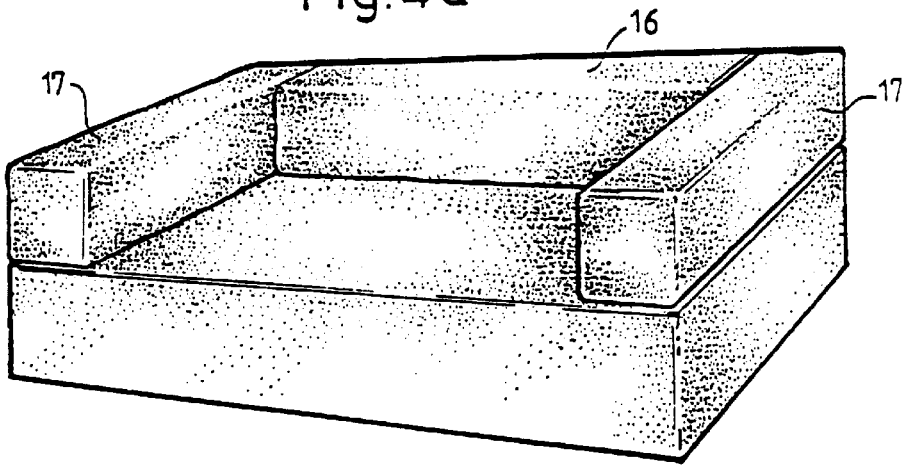
FIG. 4*a* shows a sofa, FIG. 4*b* a mattress and FIG. 4*c* a bed according to the invention.
Figure 5:
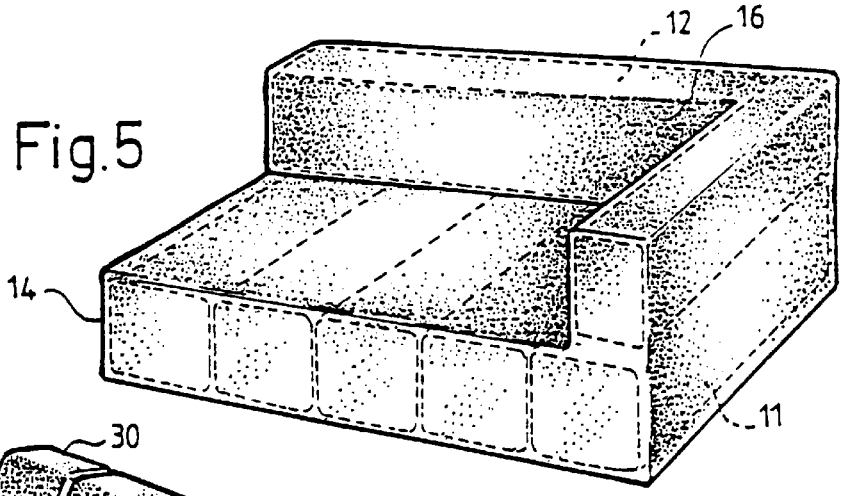
FIG. 5 shows a couch according to the invention with support elements indicated.
Figure 4B:
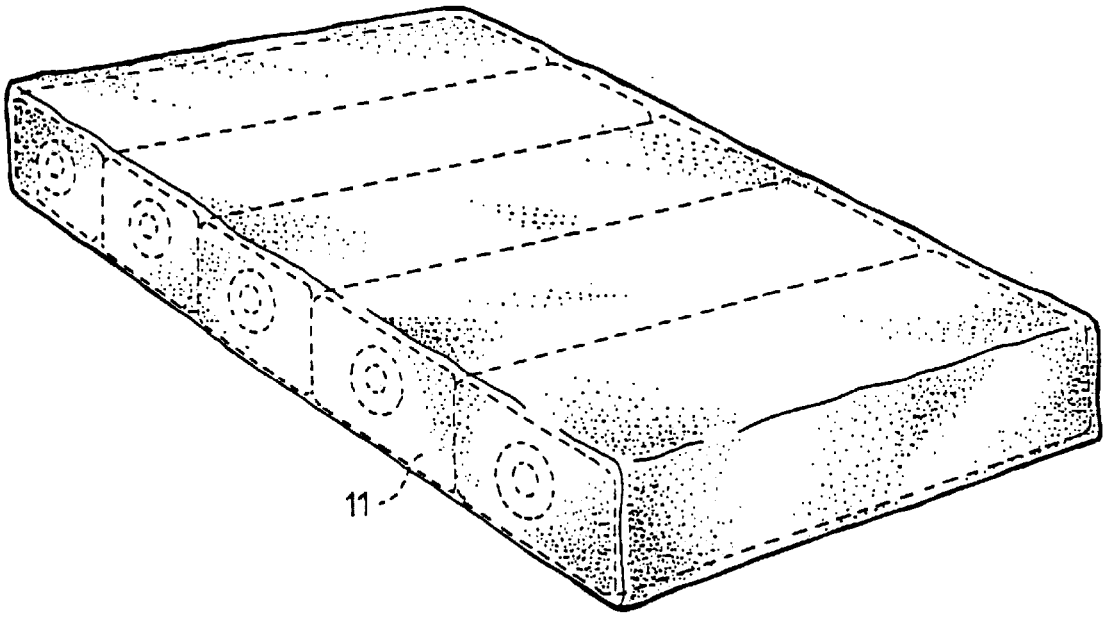
Figure 4C:
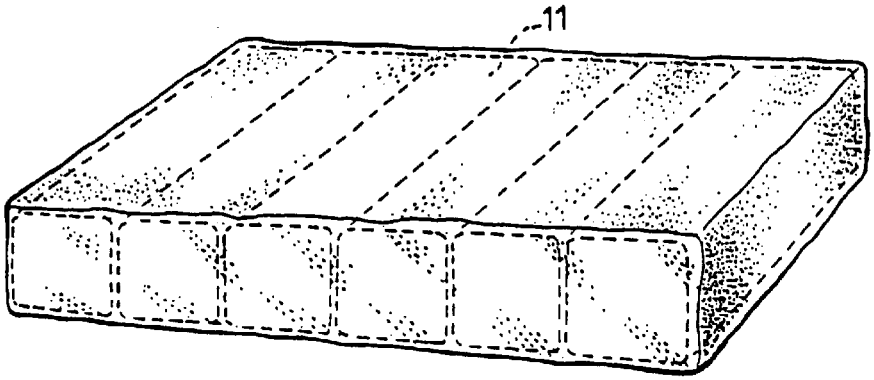

FIG. 4*a,b,c* and 5 show variants of the piece of furniture according to FIG. 2*a,* wherein the support structure consists of five essentially prismatic support elements 11 (FIG. 5*b*) and the side/arm cushions 17 as well as the back cushion 16 being made of support elements 12 (FIG. 5) of essentially prismatic shape and preferably, but not necessarily, of the same shape as the support element 11. Also in this case the cover 14 may entirely surround the support elements 11, and the cover for the side and back cushions may be attached thereto by means of bands, fasteners, VELCRO® hook and loop type fasteners or the like. As is indicated by FIG. 5, the furniture item also may be provided with an integral cover 14 covering the support structure as well as the arm/back cushions. FIG. 4*b* shows a mattress with five elements 11 inside one cover and FIG. 4*c* shows a bed with six elements inside one cover. Products according to this invention are easily kept free from sources of allergy, because of the possibility of washing the entire cover in an ordinary washing machine and washing the containers under the shower.

Figure 6A:
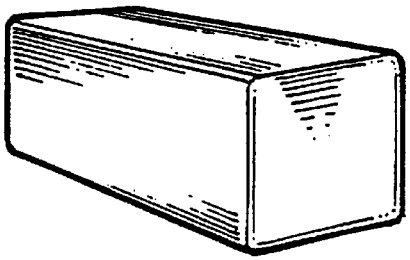
FIG. 6*a–c* show a support element in an expanded state (a, c)and in a collapsed state (b)
Figure 6C:
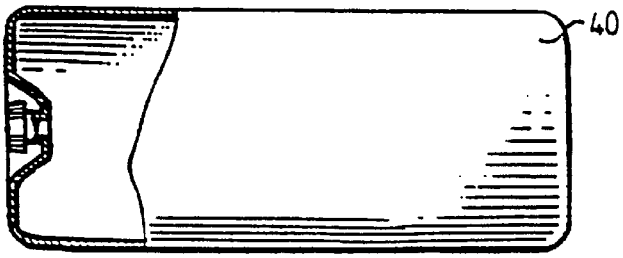
Figure 6B:
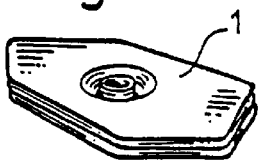

FIG. 6*a* and *c* show the appearance of an expanded support element and FIG. 6*b* this support element in a collapsed state as flat as possible, which is preferred in connection with the soft polymeric material which is used in accordance with the invention. Hereby several support elements with very large expanded volume in use may be transported in a relatively very small volume.

Figure 7:
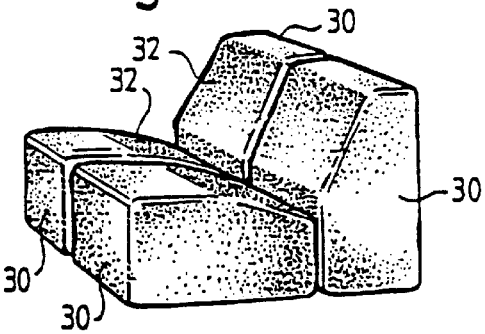
FIG. 7 shows the support structure of an easy-chair designed according to the invention.

FIG. 7 shows the basic support structure of an easy-chair with in this case four elements 30 intended to be surrounded by a cover sewn to shape. The elements 30 are identical in this case and comprise inclined surfaces 32 for increased comfort so as to achieve particularly comfortable sitting angles.

To increase the comfort of a piece of furniture according to e.g. FIG. 2*a* or 4, the extent of filling with filling media, such as air, may be varied for the different support elements. Thus, e.g. the support elements for the back support may be expanded somewhat more than the support elements intended for sitting on to achieve a comfortable relaxed laid back sitting position where the user gets proper support for his back.

Figure 8A:
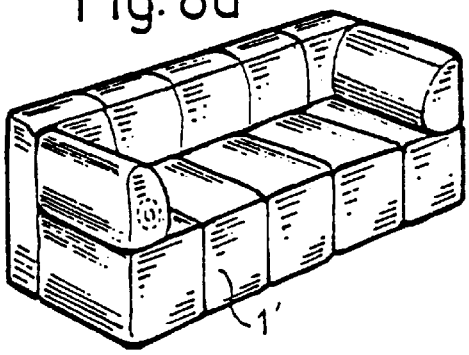
FIGS. 8*a–f* show a support structure according to the invention (a, b) and in sequence the procedure of mounting a furniture item according to the invention c–f), FIGS. 9*a* and *b* illustrate measures for increasing the weight of furniture items according to the invention.
Figure 8B:
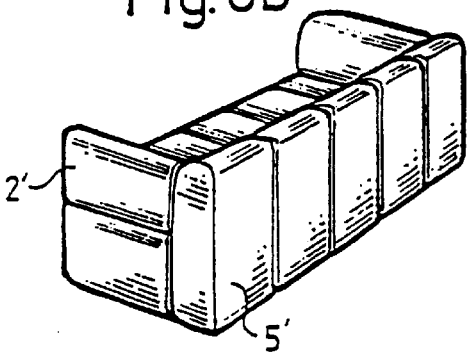

FIG. 8*a* and *b* illustrate an alternative support structure for a sofa. This principle is also applicable to easy chairs. The furniture item support structure is comprised of seat elements 1', back elements 5' which extend (in use) from the top, forming the back support, to the floor level, and arm support elements 2'. The cover 14' surrounds all support elements and is sewn to control and stabilize the furniture item.

Figure 8C:
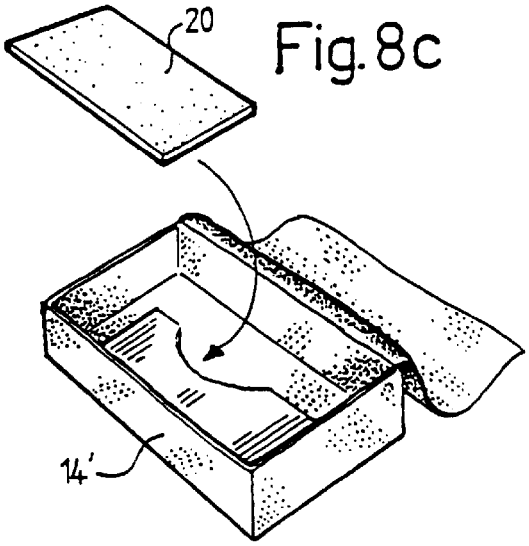

The process of mounting the furniture item includes the following steps:

FIG. 8*c*: Placing a levelling layer 20 for comfort purposes in a pocket inside the cover and closing said pocket. (This step could be left out in many applications). Layer 20 could be could be comprised of foamed polyether, batting, fibrefill or the like or combinations thereof.

Figure 8D:
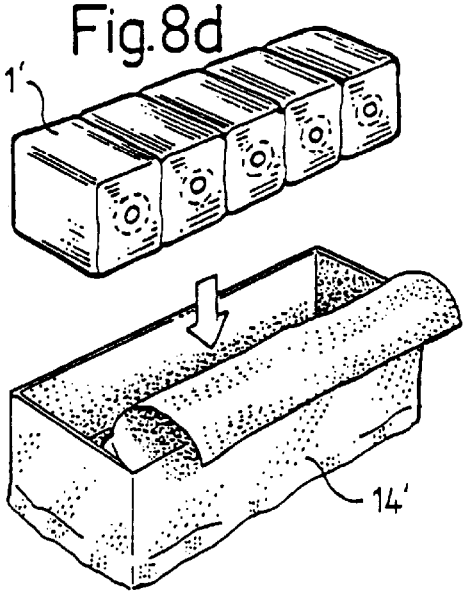

FIG. 8*d*: Placing the seat elements 1' in a seat element compartment. Closing said compartment (with zippers, etc.)

Figure 8E:
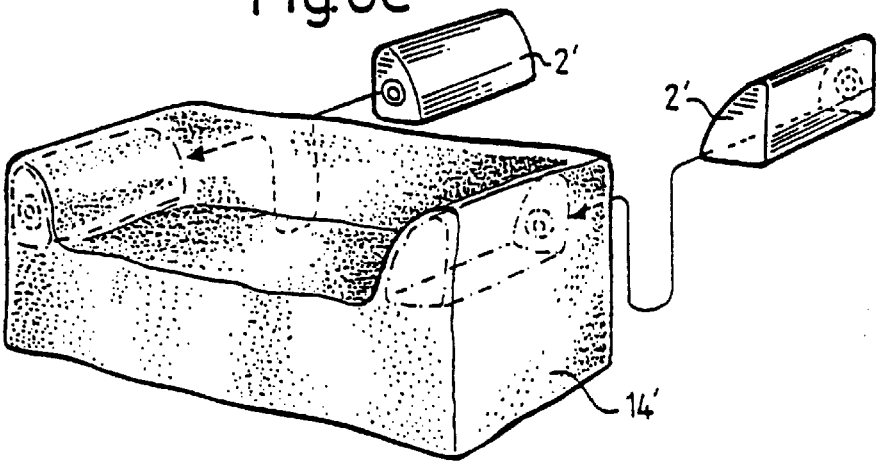

FIG. 8*e*: Placing the arm cushions 2' in their respective compartments. Closing said compartments.

Figure 8F:
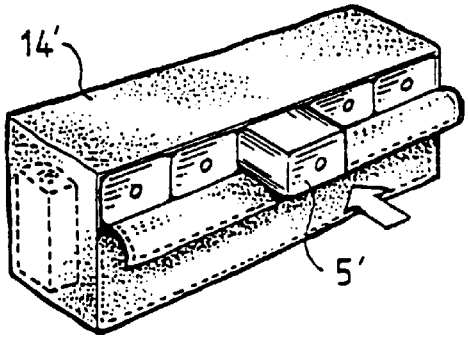

FIG. 8*f*: Inserting the back elements 5' in their compartment. Because of tight fit this step is normally ended by inserting one of the centrally placed back elements according to the arrow which normally meets certain resistance and therefore demands forcing the element into place. If the material of the element includes a slip agent this step as well as a possible finishing adjustment of the completed piece of furniture is radically simplified.

Figure 9A:
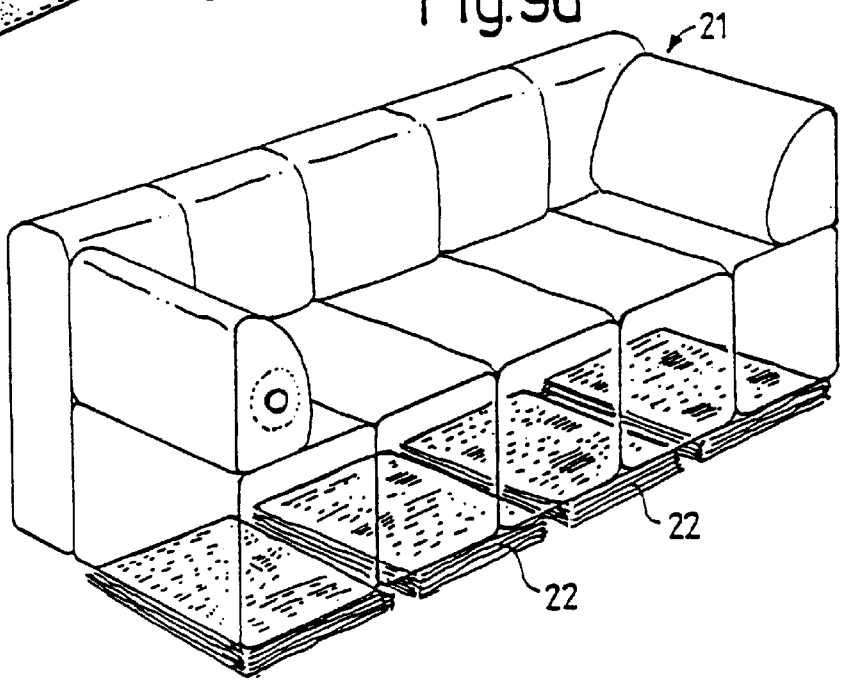
Figure 9B:
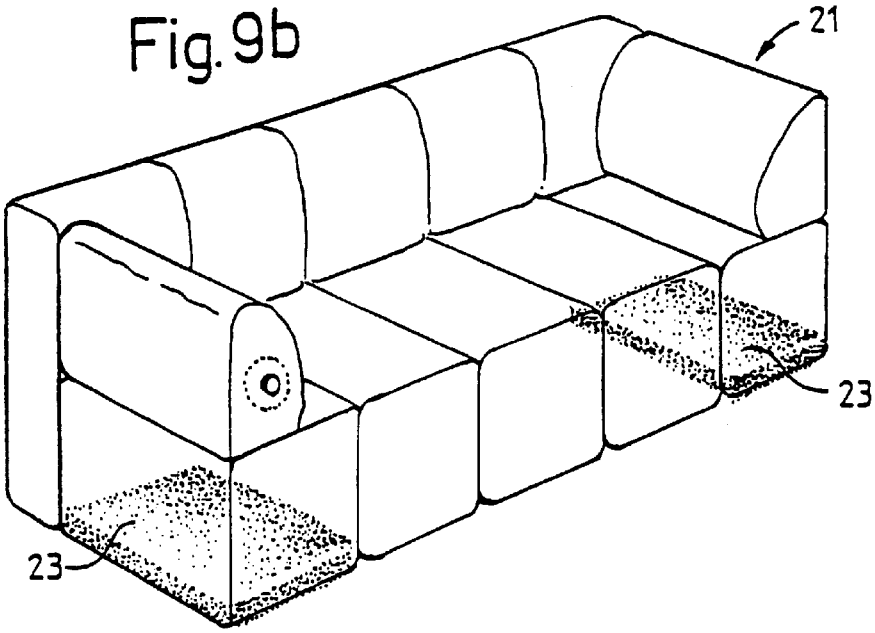

FIGS. 9*a* and *b* illustrate how the sofa according to FIG. 8 could be provided with measures for increasing the weight for stabilizing purposes if desired. 22 indicates packets of newspapers placed under the elements and inside the cover (not shown). 23 indicates sand or water inside at least some of the seat elements. Partially filling the elements with sand or water is of course possible with regard to the dimension of the opening.

Figure 10:
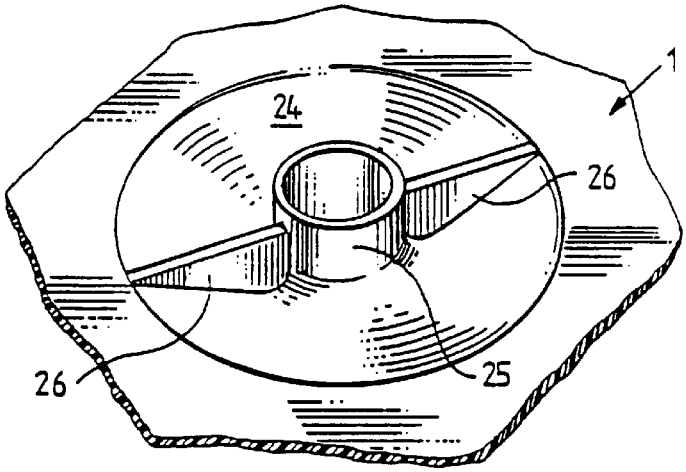
FIG. 10 shows a neck portion controlling means, FIG. 11*a* and *b* illustrate the procedure of adjusting the elements, FIGS. 12*a* and *b* show an adjustment device according to the invention.

FIG. 10 show a portion of a container element 1 with a recess 24 and a neck portion 25 extending from the bottom of the recess. In many applications, particularly in elements comprising seat elements, the load from the user could tend to press out the recess 24, so that it forms an outwardly extending funnel-like portion. In order to avoid this such elements are (or could be) provided with bridge portions 26 extending radially from the neck portion at the bottom of the recess, for stabilising the recess in the desired inward position. The bridge portions are easily produced in various processes and are particularly easy to produce in a blow moulding process by simply making corresponding grooves in the mould.

In other elements however it is desired to be able to somewhat increase the rigidity of the inflated element which could be obtained by pulling out the recess during the inflation and pressing it back inwardly after closing the element.

Figure 11A:
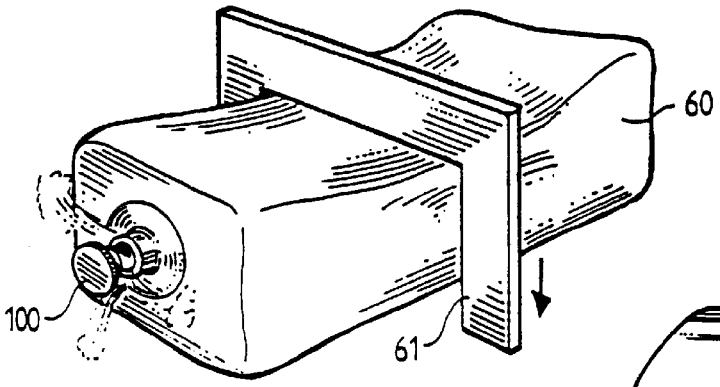

FIG. 11*a* shows the use of a device for controlling and adjusting the extent of filling of the elements. A container element is indicated with 60 and a U-shaped fixed adjustment device with 61. As can be seen from the figure, an element 60 which is filled with an over measure of air is placed on a plan surface as e.g. the floor, whereafter the adjusting device 61 is put with its uprights astride of the element. To obtain the desired extent of filling, the device is pressed with the free ends of its uprights against the floor, so as to render the desired extent of filling to the element 60. When this procedure is completed, the closing element is quickly inserted into the opening of the neck portion. It could also be necessary to choke the outflow of air with the closing element during the adjustment process.

Figure 11B:
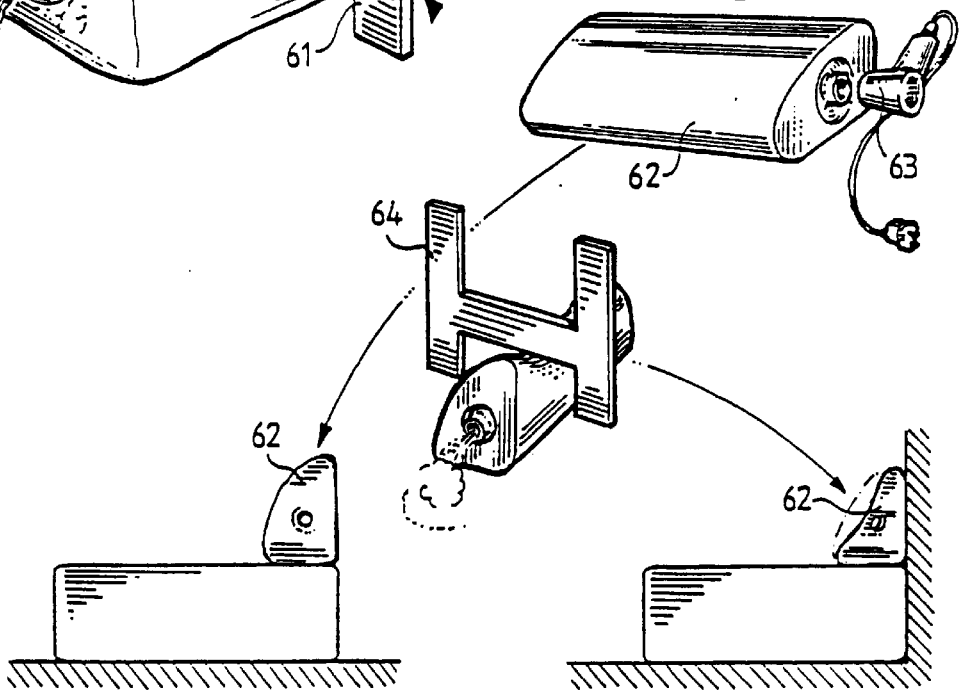

FIG. 11*b* is intended to show the entire expanding process for a container element 62, including inflating with a hair dryer 63, closing the element and using it directly (at a free standing furniture item, the left bottom figure) or reducing the extent of filling while using the adjustment device 64, which in this case is shaped as an H for allowing adjustment of different kinds of elements. The adjustment device 64 thus comprises two fixed adjustment possibilities. When the back rest element 62 is used on a furniture item standing against a wall, the extent of filling should be reduced as is shown in the bottom figure to the right in FIG. 11*b*.

Figure 12A:
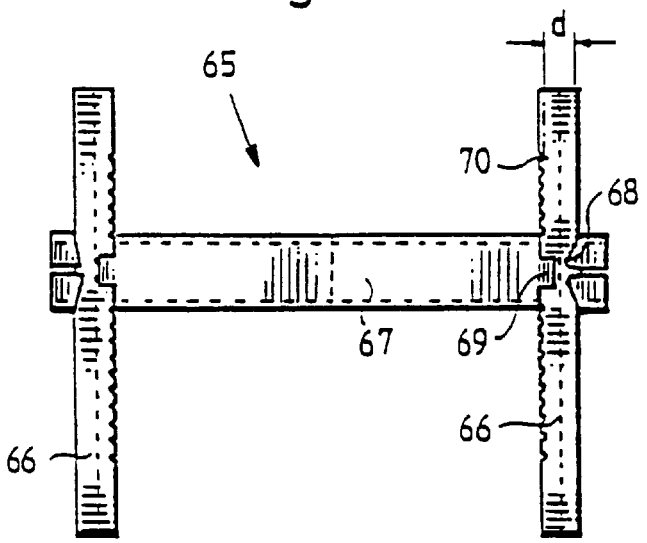
Figure 12B:
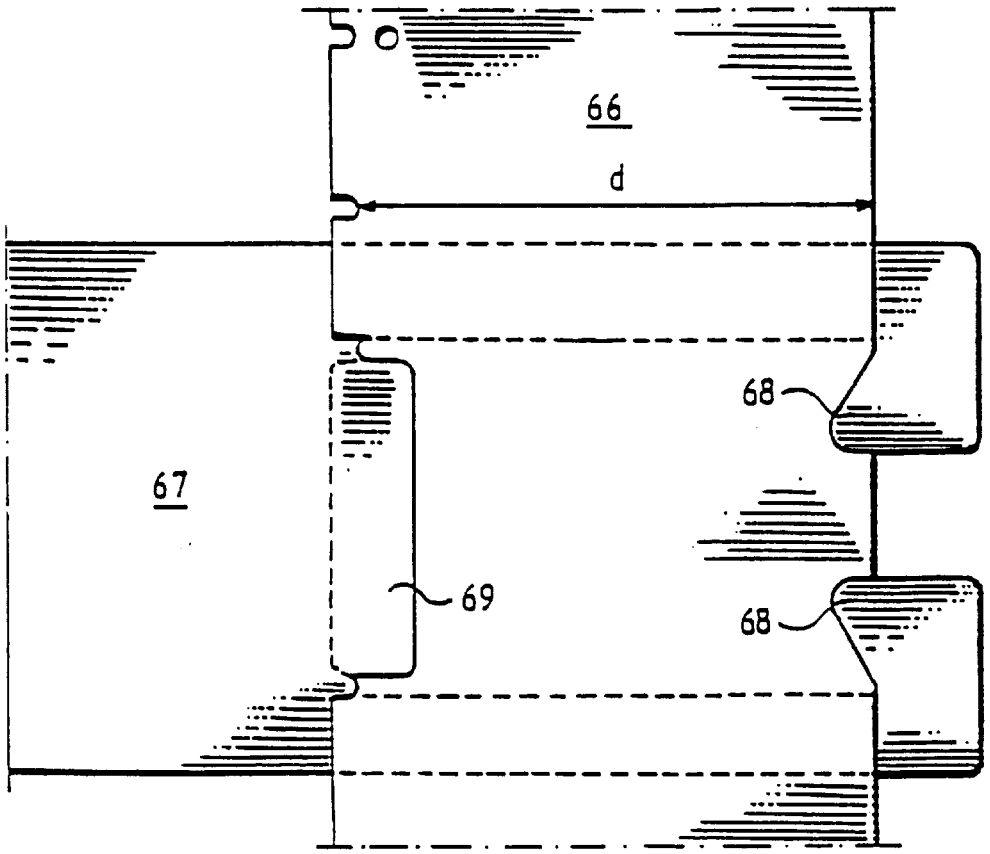
Figure 13A:
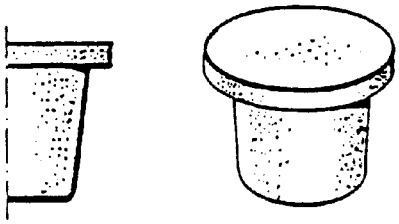
FIG. 13*a–e* show different examples of closing elements according to the invention.
Figure 13B:
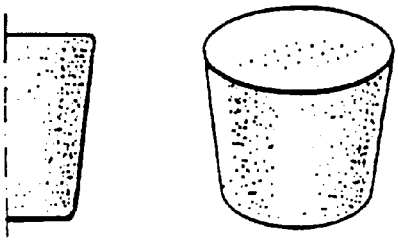
Figure 13C:
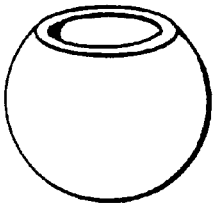
Figure 13D:
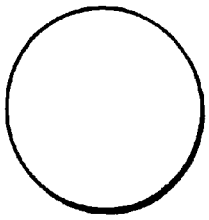
Figure 13E:
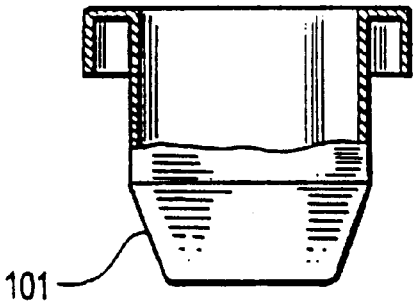

In order to obtain an adjustable adjustment device 65, in FIG. 12*a,* it is preferred that the uprights 66 are releasably fixed to the horizontal portion 67. In this case this is achieved by providing the uprights 66 with cut-out notches 70 distributed along one of its vertical sides. The horizontal portion 67 features at each end area a corresponding cut-out which comprises a width corresponding to the distance d between the bottom of the notches 70 and the other side of the uprights. Tongue portions 68 and 69 extending from the respective sides of the horizontal portion cut-out provide holding action vis-a-vis the uprights when the device 65 is properly mounted as can be seen on FIG. 12*b*.

A particularly suitable design of cushion pillows and the like is achieved if an elastic textile for covering the element is shaped in undermeasure and fixed to the element by an elastic band-shaped element. This principle is also available in connection with non elastic textiles and gives good fit for the covering material.

Since the invention is not limited to the above examples but only to the scope of the following claims, also furniture items of other combinations may of course come into question. It is hereby to note that the system according to the invention allows individual freedom for the user with respect to the structural design of furniture as well as with respect to the hardness/softness, as well as e.g. seat height, because the system allows a certain variation in the volumetric coefficient of the support elements. Freedom is also achieved for manufacturers and distributers of the system according to the invention, since a limited number of components may be combined into a large number of different furniture units.

A combination of elements of different kinds is also possible within one and the same piece of furniture, whereby as an example material with greater softness and thus higher comfort is used in certain parts, such as e.g. certain seat elements and/or cushions, while stiffer material and thus possibly cheaper and/or more wear resistant may be used in other parts.

It is also possible to combine elements according to the invention with conventional furniture elements in order to obtain certain effects, such as increased rigidity, increased seat height, higher back rest or aesthetic effects. Combinations with metal parts, wood parts etc. are therefore possible.

As indicated above the container/support elements may comprise widely different shapes, even if generally prismatic shape, and preferably with a rectangular, triangular or partly circular cylindrical cross section and rounded edges, are particularly useful.

Preferably larger pieces of furniture according to the invention comprise, as indicated, several support elements for retained comfort. It is hereby preferred that the elements as well as the production tools for the elements are modularized. This latter particularly concerns tools for blow moulding and essentially brings down the tool costs, because the moulds or forms are separable and mid sections of different lengths are insertable between end sections. This way a large number of modules may be obtained with a minimum of tools and tool parts.

A great spectrum of materials comes into question for support elements/containers according to the invention. The materials must however be soft and flexible polymeric materials in order to guarantee the comfort for the user. Further the materials must have acceptable impermeability properties. Such materials could be found within Shore A 35–Shore D 80 when chosen from the group: Polyolefins or polyolefin based materials, thermoplastic elastomeres, rubber and polymeres and/or copolymeres with additives preferably softeners. Even PVC could be acceptable in certain situations although this material normally is considered hostile to the environment. Favourable price and further good properties make however thermoplastic materials preferred and particularly such material with polyethylene as the main component. Materials which have been found suitable include EMA, EBA and EVA, and also EEA, VLLDPE and TPE type VYRAM or similar are possible.

These latter materials are readily recyclable with conventional techniques in most countries and therefore provide environment friendly solutions. Preferred materials include about 17–40% EMA, or more preferred about 20–30% EMA, or most preferred about 24–26% EMA with polyethylene, preferably LDPE as the main constituent. The cost of this material is at present about 33–50% of the cost of corresponding more rubber like material. These materials including polyethylene may be made more easily handled with respect to blow moulding, by mixing a peroxide, preferably 1000–1100 ppm into the starting material. This way the melt flow rate is improved and the slight but however noticeable smell emanating from some of these materials is toned down and "levelled". The support elements/containers which are blow moulded from these materials have been proved to achieve surprisingly good properties with respect to low permeability, softness and flexibility as well as a pleasant surface. As an example it can be mentioned that other polyolefins may be suitable, such as polypropylene, and particularly a quality being marketed as ADFLEX 7036®. Other possible but more expensive materials are VISTAFLEX® and SANTOPREN®. Elastomeric plastics as e.g. polyurethane, and rubber or rubber based materials may also be used but these materials may not be recycled at reasonable costs at the present state of the art but may have other advantages, such as better comfort etc. If deemed necessary some of the materials according to the above could be provided with a layer for further reducing permeability.

The wall thickness is calculated with respect to expected load as well as the material being used, with respect to both permeability and the inherent properties of the material. The volume of the element also is considered when dimensioning the wall thickness. For pieces of furniture for normal use a wall thickness of between 0.3 and 1.5 mm is generally sufficient. This applies to "general average thickness" of the greater part of the wall of ≈ 0.6–0.9 mm when the elements are blow moulded. It should also be noted that the wall thickness may vary between different parts of the support elements depending on method of manufacture. Blow moulding thus gives thinner wall in the corner and edge areas. Generally it is desired that a material is used which has sufficiently low permeability, but within the scope of this invention also lies coating the inner or outer sides of the elements in different ways or mixing into the material substances which further reduces permeability. With the above mentioned materials and with the indicated wall thicknesses it is fully realistic to calculate with the support elements within the system retaining the desired inner air volume during such a long period as statistically 5–8 years, but periods of up to about 10–15 years and even beyond may also come into question with a laminated wall.

It is not excluded to use porous materials with closed cells as the wall material, and different kinds of rubber, such as neoprene are possible. In this case the wall thickness preferably ranges up to about 3 mm.

The invention also generally concerns a method of producing a large thin-walled container of a soft and flexible polymeric material by blow moulding in a mould.

Introducing the starting material in the form of a heated tube into the mould and blowing is carried out conventionally but after the blowing action, when the completed container is taken out from the mould, it is essentially immediately inflated to a prescribed, normally slight, overpressure. This is achieved by a blower which preferably also is adapted to finally insert a production closing element into the neck portion by means of the blowing action. The container is thereafter retained in this inflated state during a period of as an example 6–36 hours. The reasons for this are: The containers will after-set in order to adapt to the desired expanded shape without tendencies of folds, impressions and other deformations. Hereby the structure in the wall material is established in the desired shape. The container element is consequently readily expanded by the subsequent user to the established desired shape.

Preferably the shape in this condition is such that all sides are slightly convex.

During this time possible smell from the material will be reduced.

The container elements are automatically tested for leakage. In order to press out possible enclosed impurities in the material to more reliably reveal subsequent weaknesses the elements are preferably exposed to temporary mechanical pressure.

The container is easily handled in its inflated state in the production facility and subsequently easily folded to a neat collapsed state quickly and without undesired folds etc. In production the inflated elements may be suspended during the test period, or as an example held by a movable band or the like, such that leaking elements will be exposed by their deflation.

When blow moulding the element incorporating an insert, the insert is preferably applied prior to the blowing operation, and is preferably preheated in order to improve fusing between the insert and element materials.

Other methods of manufacture are however possible and different seam welding operations as well as seam welding in combination with vacuum thermoforming could be mentioned in this connection.

Embodiments of closing elements for cooperation with an air inlet opening of a support element according to the above is shown as examples in FIG. 13, said element being: plug-shaped respectively with or without a flange portion (FIG. 13*a, b*) truncated, truncated hollow ball-shaped (FIG. 13*c*), which shape enables easy application and removal; ball-shaped (FIG. 13*d*), which is more difficult to remove, may be hollow or massive foam; or cup-shaped (FIG. 13*e*) with narrow entering portion 101. As has been mentioned above it is essential that the opening of the support element may be closed quickly and simply after the expansion, since too much tangling with the element with respect to the closing thereof allows air to escape and may lead to the element being insufficiently expanded. The design of the closing element is therefore such that the element on its entering side has a smaller dimension than the diameter of the neck portion so as to allow easy establishment of a closed state. After entering the neck opening, the element may be pushed for fixation within the neck portion which is shaped in such a way that it may easily be gripped by the hand.

A particularly suitable closing element is produced of a generally cup-shaped, thin-walled body from a synthetic material, and is comprised with a radially outward directed flange for covering the outer edge of the neck portion for the protection of textiles etc.

It is preferred that said flange is continued with an annular portion covering said outer edge. When dimensioning it is assured that a certain play is present between the flange and the outer edge of the neck, to allow possible later after insertion. Thus the diameter of the body somewhat exceeds the diameter of the neck portion. The chosen material comprises so called "frottage", i.e. the friction between the surface of the neck portion and the surface of the element ensures sufficient fixation and sealing. A further advantage with sealing within a neck portion of this kind is that this area may be produced in an even smooth condition and without burr, seams or the like already directly after the manufacture, why no manual clean shearing precision operation needs to be applied. Outwardly the neck portion there however may be such burr and the like. Placing of the neck portion into a vaulted or depressed portion of the support element produces a clean and smooth outer surface of the resulting piece of furniture. A possible closing element consists of expanded foamed material throughout, such as expanded LDPE/PP. It is generally a desire that the closing element may be recycled together with the material of the container. Such materials are therefore preferred.

Due to the large volume of the containers, the inside pressure is very low such that the closing element only must withstand a maximal overpressure of around 0.05 bar. This is easily taken care of in a short term period by the frottage of the conical element, but for assuring long term effect the closing elements must be fixed in the closing position.

Figure 14A:
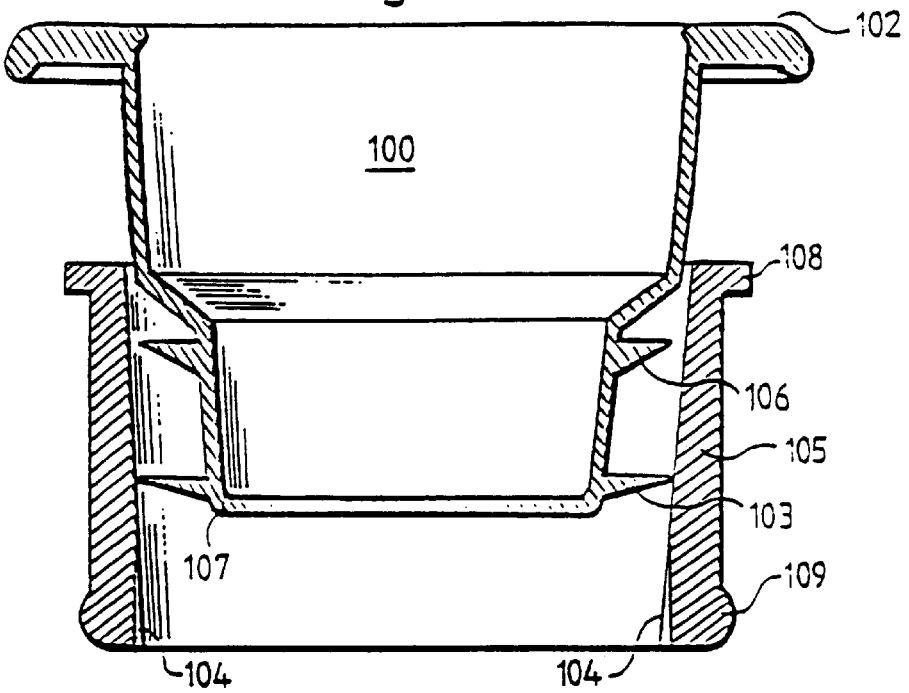
FIG. 14*a* shows a preferred closing element and an insert for a neck portion.

FIG. 14*a* shows a preferred embodiment of the closing element 100 cooperating with an insert 105. The element 100 is generally cup-shaped with narrower inner portion and wider outer portion, said portions being connected by an intermediate strongly tapering portion. On its inside entering portion 107 the closing element is provided with radially extending flange portions 103 (see FIG. 14*b*), partly surrounding the entering portion, which correspond to grooves 104 in the inner, more narrow, part of the slightly conical inner surface of the insert. FIG. 14*a* shows the closing element in a "temporary closing state", which is easily obtained because of the construction of the respective parts, allowing the user to fast and easy apply the closing element into the neck portion or insert. Locking action is obtained by slightly rotating the closing element in the fully inserted position. It could also be obtained by snap-action of the flange portion 103 vis-a-vis the inner edge of the insert. It is possible to press in the closing element in any position, hereby a "clic" indication is delivered at the completed insertion. Using the grooves demands less power for insertion/extraction of the closing element and alignment is recommended for physically weak persons. Sealing is achieved by sealing flange 106 acting against the inner surface of the insert (more than one sealing flange 106 may be provided) and by the somewhat biconvex outer portion sealing against the corresponding part of the insert. The outer flange 102 facilitates application and handling the closing element and covers the outer part of the neck portion (see above).

FIG. 14*a* shows in detail the appearance of the insert 105 with an outer annular flange 108 which is intended to form the outer part of the neck portion and, at its other end, with an annular rounded, radially outwards directed ridge portion 109 which assures good joining of the insert and the material of the container element.

Figure 14B:
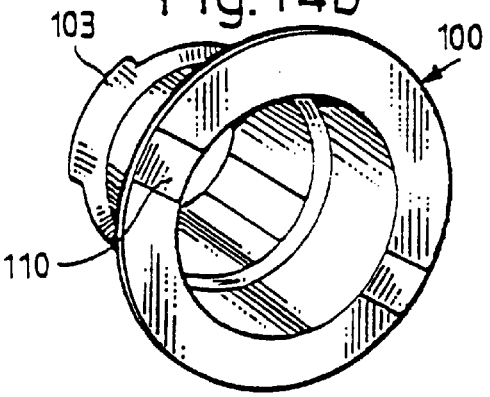
FIG. 14*b* shows diagrammatically the element of FIG. 14*a* in a Perspective view, FIG. 15*a* and *b* illustrates an alternative preferred closing element and a neck portion with an insert respectively.

FIG. 14*b* shows the closing element with an indicator marking 110 which informs the user of the position of the flange portions. The insert may be provided with a similar marking indicating the positions of the grooves.

Figure 15A:
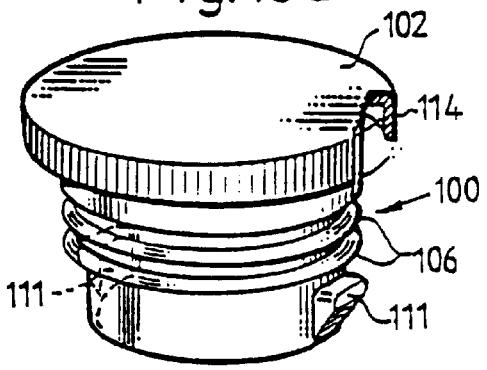
Figure 15B:
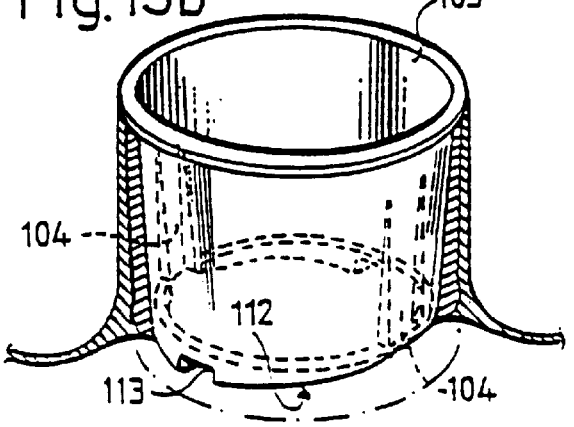

FIGS. 15*a* and *b* show a similar solution, but here the closing element is provided with radial protrusions 111 at its inner region, said protrusions being adapted to cooperate with cam surfaces 112 at the inner end of the insert. After complete insertion of the closing element 100 into the neck portion it is rotated one quarter of a revolution in order to obtain a rest position in depressions 113 in the cam surface 112. The closing element further comprises two sealing flanges 106 and an axial outer extension 114 of the flange 102 (see the above discussion).

The closing element may of course be embodied otherwise, and as an example it is possible to use other fastening means, such as threads inside an insert or outside the neck portion. Such threads could cooperate with the part 114 or cooperate with an additional lid (not shown) covering the outer part of the neck portion.

Figure 16:
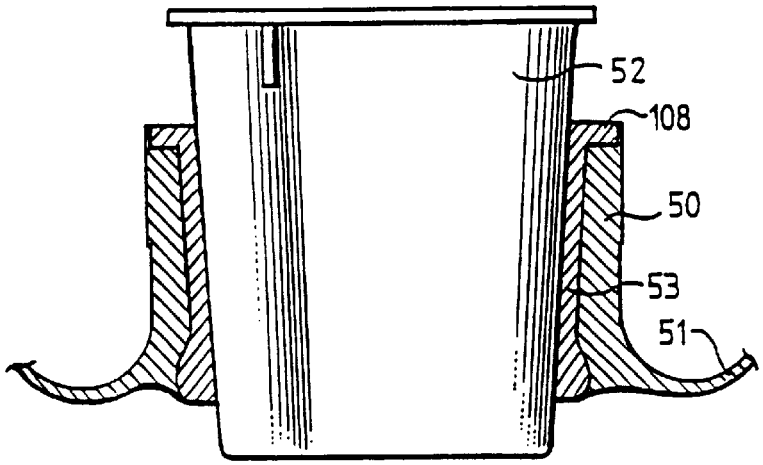
FIG. 16 shows a closing element, which is used in the process of producing elements according to the invention inserted in a neck portion.

FIG. 16 shows a closing element 52, which is used in the above discussed leakage test, applied into a neck portion 50 comprising an insert 53. This figure clearly shows the position of the neck portion in the depressed portion of the wall 51 of the container/support element. Preferably the blow mould material surrounds also the outer flange radially outside as a consequence of the process. As can be seen from this figure, the closing element is comprised of a plain cup-shaped element of a slightly conical form.

Figure 17:
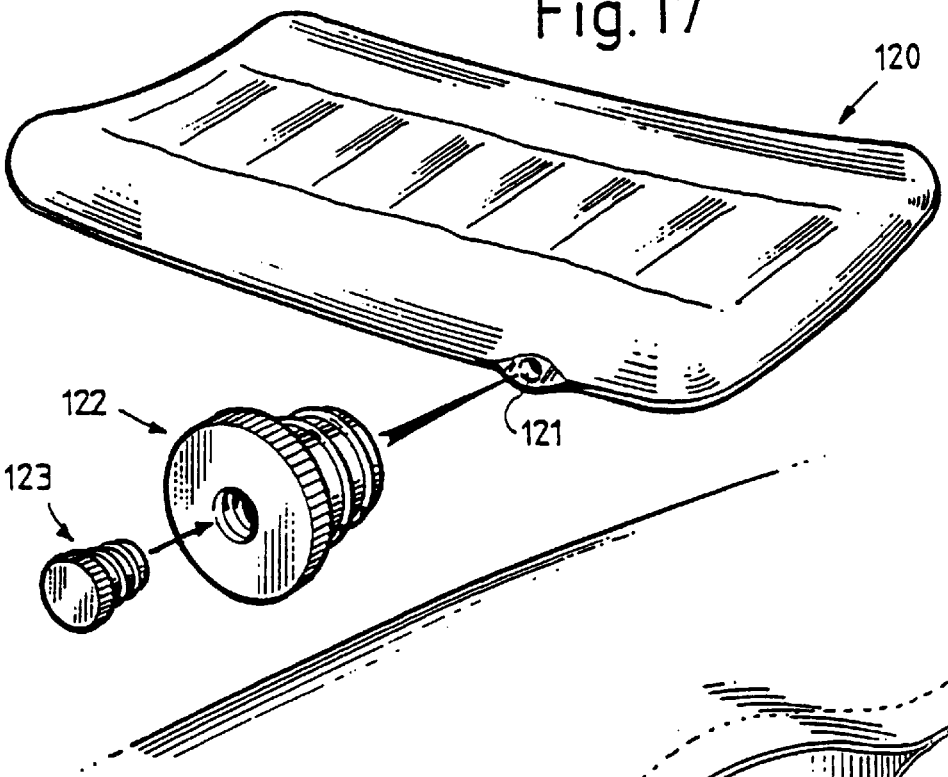
FIG. 17 shows an inflatable mattress with a closing means shown in an enlarged scale in FIG. 18.
Figure 18:
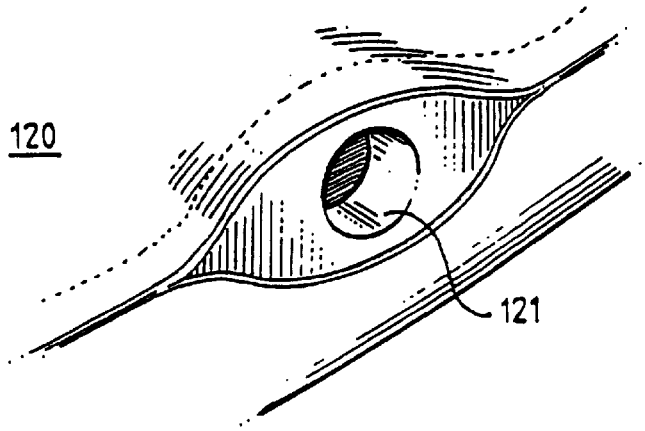

FIG. 17 illustrates another invention aspect which is covered by this application.

When inflating an inflatable mattress according to the invention, the user is normally directed to use a particular air pump which is laborious and time consuming to use. This invention aspect aims to solve this problem.

This way the mattress may be partially, almost fully, inflated by using an ordinary hair dryer of the type that has been described above with respect of the previous aspects of this application.

Several advantages are achieved this way. The time for inflation will thus be radically reduced and the pump needed for the very final inflation can be simple and comprise relatively low capacity.

A mattress 120 is thus provided with an opening 121 allowing cooperation with said hair dryer. The closing means consists of a first part 122 having dimensions so as to sealingly cooperate with the opening. Axially the first part is provided with a through hole, the inner diameter of which is determined so as to enable cooperation with a mouth piece of a pump. This hole also cooperates sealingly with the second part 123 of the closing means so as to obtain a final tight closing.

When inflating the mattress according to the invention the hair dryer is used initially until only a fraction of the volume remains to be filled. Thereafter the first part 122 is introduced into the opening 121, preferably with the hose of the pump inserted into the hole. Then the final inflation may take place. Finally the hose is removed and the second part 123 sealingly inserted into said hole.

It is also possible to provide intermediate elements between the first and the second parts so as to enable use of mouth pieces of different diameters. It is also possible after inflation with the hair dryer to use a mouth piece extending from the hole in the first part 122 so as to facilitate for the user to blow with his mouth.

I claim:

1. Container element comprising a closable thin-walled container of a polymeric material, said element from an empty collapsed state being fillable to an expanded state so as to form a support structure or part thereof of a piece of a cushion, said element having an air inlet opening for filling/emptying and for the co-operation with a closing element for closing said opening, the opening comprising an integral neck portion with an inner diameter ranging between about 30–50 mm, allowing:

i) co-operation with a blower function of a hand held hair dryer, ii) expansion by blowing with the mouth, iii) inserting and applying through the opening a sealing element for repair purposes on an inside wall of the container element, iv) easy inflow/outflow of air, and V) the neck portion forming a handgrip;

said neck portion being surrounded by a cup-shaped portion of the container, and at an inner end joining to a bottom of said cup-shaped portion, so as to allow one of an outer part of the neck portion and an inserted closing element, to remain in a plane of a wall part of the container element surrounding said cup-shaped portion, when the element is filled with air, wherein a wall material in said container element is a low-permeable, soft and flexible polymeric material, the container element being blow moulded in one piece and having a volume ranging between 30 and 120 liters, and said neck portion and at least a part of said cup-shaped portion having a greater wall thickness than an average wall of a remainder of the container element, thereby giving said portions a greater stiffness than the remainder of the container element.

2. Element according to claim 1, wherein the container element consists of a plastics materials selected from the group including low density polyethylene (LDPE), EBA and ethylene methyl acrylate (EMA).

3. Element according to claim 2, wherein said material includes EMA, by 17–40% and with LDPE as a main constituent.

4. Element according to claim 3, wherein the material includes EMA by 20–30%.

5. Element according to claim 1, wherein the wall comprises at least two layers of material, one of said layers having low permeability.

6. Element according to claim 5, wherein the material having low permeability is EVOH.

7. Element according to claim 1, wherein said container element essentially has a shape selected from the group: a prism, a parallelepiped, a cylinder, and a pillow.

8. Element according to claim 7, wherein the shape comprises rounded edges and corners and convex main surfaces.

9. Element according to claim 6, wherein the shape comprises at least one rounded side and one more plane side.

10. Element according to claim 1, wherein the closing element has an entering portion of a smaller diameter than an inner diameter of a free end of the neck portion, so as to allow quick establishment of a closed state, and controlled outflow of air when adjusting the expanded state.

11. Element according to claim 10, wherein the closing element is cup-shaped and comprises a flange at an outer part for covering a surface of the neck portion which is directed outwards.

12. Element according to claim 11, wherein the flange further comprises an annular portion surrounding said surface.

13. Element according to claim 10, wherein the closing element is manufactured from a material and with such a structure that the closing element is recyclable together with the container element.

14. Element according to claim 1, wherein an inside wall of the neck portion is at least cylindrical, whereas the closing element has a conicity slightly exceeding that of an inside wall of the neck portion.

15. Element according to claim 1, wherein said neck portion is provided with a preprepared tubular insert, providing a seat for the closing element.

16. Element according to claim 15, wherein said insert includes a material at least slightly harder than the container element.

17. Element according to claim 15, wherein the insert on an inside surface is provided with surfaces co-operating with the closing element.

18. Element according to claim 1, wherein the wall thickness is between 0.3 and 1.5 mm.

19. Furniture item including the container element of claim 1, wherein more than one support element is used, and a cover for the elements defines the shape of the furniture item.

20. Furniture item including the container element of claim 9, wherein the cover, in use at least partly surrounding the support elements, includes a fire-proofing material.

21. Furniture item including the container element of claim 9, wherein the elements are capable of being inflated to 75–90% of their maximum volume.

22. Device for allowing adjustment of a container element as defined in claim 1, wherein said device in use at least partly exhibits a shape of an inverted U so that said device may be placed with uprights astride of the container element and such that a horizontal portion is placed a measured distance from free ends of the uprights so that an extent of filling of the container element may be controlled.

23. Device according to claim 22, wherein the horizontal portion is fastened to the uprights in a releasable manner in a chosen position.

24. Method of manufacturing a relatively large thin-walled container element of a polymeric material, which from a collapsed condition is fillable with a medium, said method comprising:

blow moulding a soft and flexible polymeric material hot in a mould, relieving the blow pressure, taking the resulting container out from the mould, expanding the container directly thereafter to the shape resulting from the blow moulding process so that it is subject to at least a slight overpressure, closing the container in this condition and retaining the container in the expanded condition during a time period for leakage control and for ensuring that the structure of the wall material is established in this condition, opening of and emptying the container, and folding the container for packaging.

25. Method according to claim 24, wherein the polymeric material includes material selected from the group: EMA, EVA, EBA, EEA, and ethylene based material.

26. Method according to claim 25, wherein the material includes EMA by 17–40% with polyethylene as a main ingredient.

27. Method according to claim 26, wherein the material includes a peroxide to improve MFR (melt flow rate), and to diminish odor.

28. Method according to claim 26, wherein peroxide is included in an amount of about 1000–1100 PPM.

29. Method according to claim 24, wherein a slip agent is included in the material.

30. Method according to claim 24, wherein the mould is a modular form or mould, which is separable, whereby intermediate sections of different sizes are insertable between end sections.

31. Method according to claim 24, wherein the inflated finished element is subjected to a mechanical overpressure in order to test possible leakage.

32. Method according to claim 24, wherein an insert is applied into a neck portion during the manufacturing process.

* * * * *